US008185264B2

(12) United States Patent
Carroll

(10) Patent No.: US 8,185,264 B2
(45) Date of Patent: May 22, 2012

(54) COMPONENT VEHICLE

(75) Inventor: Caleb Carroll, Newcastle Upon Tyne (GB)

(73) Assignee: Nomad Spectrum Limited, Tyne and Wear (GB)

( * ) Notice: Subject to any disclaimer, the term of this patent is extended or adjusted under 35 U.S.C. 154(b) by 0 days.

(21) Appl. No.: 12/809,972

(22) PCT Filed: Dec. 18, 2008

(86) PCT No.: PCT/GB2008/004194

§ 371 (c)(1),
(2), (4) Date: Sep. 22, 2010

(87) PCT Pub. No.: WO2009/081119

PCT Pub. Date: Jul. 2, 2009

(65) Prior Publication Data

US 2011/0046826 A1 Feb. 24, 2011

(30) Foreign Application Priority Data

Dec. 21, 2007 (GB) ..... 0725001.2

(51) Int. Cl.
*B61L 15/00* (2006.01)
*G06F 7/02* (2006.01)

(52) U.S. Cl. ..... 701/19; 701/36; 342/125; 342/145; 246/167 D; 246/167 R; 73/627; 324/635

(58) Field of Classification Search ..... 701/19
See application file for complete search history.

(56) References Cited

U.S. PATENT DOCUMENTS

| | | | | |
|---|---|---|---|---|
| 3,680,085 | A * | 7/1972 | Del Signore | 342/128 |
| 5,090,779 | A | 2/1992 | Kramer | |
| 5,191,328 | A | 3/1993 | Nelson | |
| 5,435,505 | A * | 7/1995 | Martin | 246/187 C |
| 5,450,226 | A | 9/1995 | Khan et al. | |
| 5,905,433 | A | 5/1999 | Wortham | |
| 6,222,443 | B1 | 4/2001 | Beeson et al. | |
| 6,273,512 | B1 * | 8/2001 | Rajewski | 299/17 |
| 6,452,535 | B1 * | 9/2002 | Rao et al. | 342/72 |
| 6,469,956 | B1 * | 10/2002 | Zeng | 367/116 |
| 6,765,393 | B2 * | 7/2004 | Pierenkemper et al. | 324/635 |

(Continued)

FOREIGN PATENT DOCUMENTS

CA 2143463 2/1995

(Continued)

OTHER PUBLICATIONS

"Columbris Local Mesh Protocol Inter-Carriage Link Tech Note"; Colubris Networks; Oct. 5, 2007; 32 pp.

(Continued)

*Primary Examiner* — Thomas G. Black
*Assistant Examiner* — Lin B Olsen
(74) *Attorney, Agent, or Firm* — Colin P. Cahoon; Celina M. Orr; Carstens & Cahoon, LLP

(57) ABSTRACT

According to an aspect of the invention, there is provided a method for determining whether first and second components of a vehicle are physically coupled together, the method comprising: transmitting a first signal from the first component of the vehicle; receiving a second signal from the second component of the vehicle; processing the second signal to determine whether the first and second components of the vehicle are coupled.

12 Claims, 9 Drawing Sheets

U.S. PATENT DOCUMENTS

Figure 1:
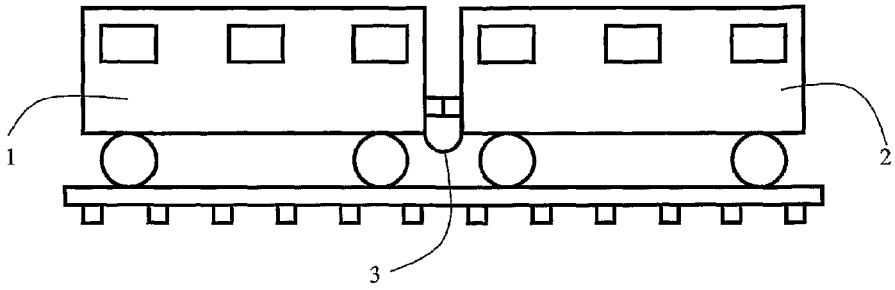

| | | | | |
|---|---|---|---|---|
| 7,263,415 | B2 * | 8/2007 | Mindel | 701/19 |
| 7,458,545 | B1 * | 12/2008 | Ricks et al. | 246/1 R |
| 7,845,504 | B2 * | 12/2010 | Davenport et al. | 213/1.3 |
| 7,932,815 | B2 * | 4/2011 | Martinez et al. | 340/431 |
| 2002/0030590 | A1 | 3/2002 | Dieckmann et al. | |
| 2003/0182030 | A1 | 9/2003 | Kraeling et al. | |
| 2003/0182303 | A1 * | 9/2003 | Gibson | 707/102 |
| 2005/0062590 | A1 | 3/2005 | Lang et al. | |
| 2007/0145196 | A1 | 6/2007 | Davenport et al. | |
| 2007/0176394 | A1 | 8/2007 | Gehring et al. | |

FOREIGN PATENT DOCUMENTS

| | | | |
|---|---|---|---|
| CA | 2461066 | A1 | 9/2004 |
| DE | 4027186 | A1 | 3/1991 |
| DE | 19711772 | C1 | 3/1997 |
| EP | 0814006 | A1 | 12/1997 |
| EP | 1065128 | A1 | 1/2001 |
| EP | 1065128 | A1 | 3/2001 |
| EP | 1205370 | A | 5/2002 |
| EP | 1205370 | A1 | 5/2002 |
| EP | 1403162 | A | 3/2004 |
| EP | 1403162 | A1 | 3/2004 |
| EP | 1465358 | | 3/2004 |
| EP | 1612954 | | 6/2005 |
| EP | 1914146 | A | 4/2008 |
| GB | 2237959 | A1 | 5/1991 |
| GB | 2336011 | A1 | 6/1999 |
| GB | 2455976 | | 7/2009 |
| GB | 2461396 | | 1/2010 |
| WO | 9842558 | | 10/1998 |
| WO | 0107310 | A | 2/2001 |
| WO | 0219566 | A | 3/2002 |
| WO | 2005-056362 | A1 | 6/2005 |
| WO | 2005056362 | A | 6/2005 |
| WO | 2007-118837 | A1 | 10/2007 |
| WO | 2007118837 | A1 | 10/2007 |
| WO | 2008004194 | | 1/2008 |

OTHER PUBLICATIONS

Prior Art Observations for UK Patent Application No. GB0725001.2 Filed Dec. 12, 2007; Sep. 23, 2009.

* cited by examiner

| ICL LOOKED UP OR LOOKED AT | ICL FOUND TO BE WIRELESSLY CONNECTED TO: |
|---|---|
| ICL 2A | ICL 6B |
| ICL 6A | ICL 4B |
| ICL 4A | NOTHING |
| ICL 2B | ICL 8B |
| ICL 8A | NOTHING |

FIG. 11a

| ICL LOOKED UP OR LOOKED AT | ICL FOUND TO BE WIRELESSLY CONNECTED TO: |
|---|---|
| ICL 2A | ICL 6B |
| ICL 6A | ICL 4B |
| ICL 4A | NOTHING |
| ICL 2B | ICL 8B |
| ICL 8A | NOTHING |

FIG. 11b

COMPONENT VEHICLE

The present invention relates to component vehicles (i.e. vehicles comprising more than one component). In particular, the invention relates to trains, but is not restricted thereto.

In recent years, there has been an increase in demand for access to information while on the move. For example, it is now common for people to access data, for example via the Internet, using their mobile phones. It has also become more common for train service providers to provide access to the Internet for users of a train. This is so that users of the train can access the Internet while travelling from location to location.

One way of providing internet access throughout components (or in other words cars) of a train is to provide a wired connection to seats or groups of seats within the train component. Adjacent and opposed components are then linked together to form a wired network. One or more of the train components may be in wireless communication with a satellite or other transmitter of information, via which access to the Internet may be obtained. This train component is then in wired connection with other train components to provide those other components with access to the internet, for example.

FIG. 1 shows an example of how a first train component 1 may be networked (in other words, able to transfer data to and from) a second train component 2. It can be seen that a wired connection 3 is provided which connects the first train component 1 and the second train component 2.

The arrangement shown in FIG. 1 has disadvantages associated with it. For instance, each time a component is decoupled from another component, any wired connections also need to be decoupled. This can take valuable time to undertake. Conversely, when a component is coupled to another component, and it is desired to network both components, a wired connection needs to be established between the components. This can also take valuable time to undertake. Furthermore, a wired connection can become disconnected or damaged, meaning that there could be a break down in the network resulting in one or more components being unable to provide users with access to the network.

Figure 2:
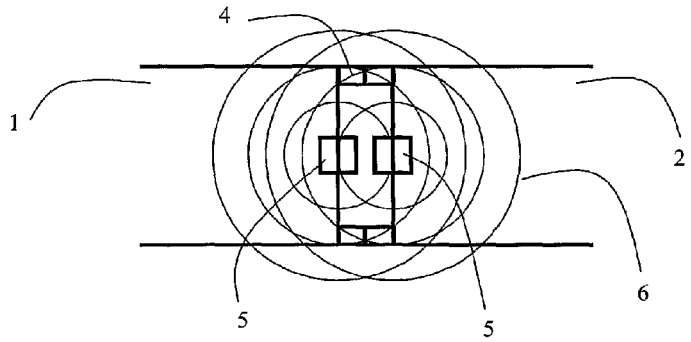

Some of the disadvantages associated with a wired connection as shown in FIG. 1 can be overcome by the use of a wireless network. FIG. 2 shows a first train component 1 and a second train component 2 coupled together by mechanical coupling elements 4. Each component 1, 2 is provided with a wireless communications device 5, which may include, for example, an antenna. It can be seen that each wireless communications device 5 transmits signals 6 uniformly in all directions, and that these signals 6 can be received by other wireless communication devices 5, for example those of an adjacent and opposed train component. Since no mechanical connections are required to transfer data between adjacent and opposed components, or in other words to network the adjacent and opposed components, at least some of the disadvantages discussed in relation to the wired connection of FIG. 1 are overcome. However, the wireless arrangement of FIG. 2 also has disadvantages associated with it.

Figure 3A:
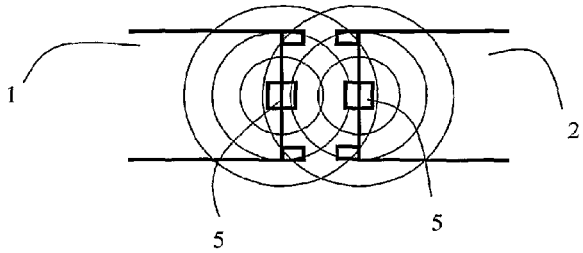
Figure 3B:
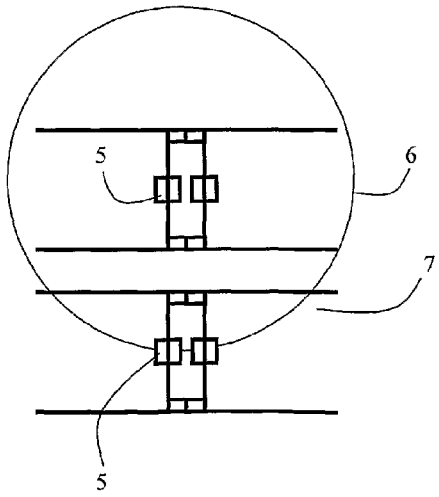

In FIG. 3*a*, a first train component 1 and a second train component 2 are shown. The components 1, 2 are not coupled together. However, it can be seen that wireless communication between the wireless communication devices 5 of each component 1, 2 is still possible. This may be undesirable, since the first train component 1 and second train component 2 may not be part of the same train. For instance, the first component 1 and second component 2 may be part of different trains which are located adjacent to one another, for example in a siding or at a platform. It may be undesirable to establish a wireless network between two different trains for any one of a number of reasons. For example, the trains may belong to different companies, have different protocols, etc, or the sharing of networks may affect the available bandwidth for those networks. FIG. 3*b* shows another problem which may occur with use of wireless communication as shown in FIG. 2. Referring to FIG. 3*b*, it can be seen that the wireless communication devices 5 of a first train 6 may communicate with and establish a network with wireless communication devices 5 of a second neighbouring train, for example on another track. Again, this may be disadvantageous. For instance, the first and second train 6, 7 may belong to different companies and/or communication between the trains 6, 7 may reduce the overall bandwidth available to users of one or both trains 6, 7.

While the problems mentioned above have been described in relation to components of trains, the problems are prevalent in any vehicle comprising more than one component. For instance, the problems are equally applicable to a lorry having a first and second component, for example a front cab and an attached load, or a car and caravan or trailer.

It is therefore an object of the present invention to provide a new or alternative method and apparatus which may obviate or mitigate at least one disadvantage of the prior art, whether identified herein or elsewhere.

According to a first aspect of the present invention, there is provided a method for determining whether first and second components of a vehicle are physically coupled together, the method comprising: wirelessly transmitting a first signal from the first component of the vehicle; wirelessly receiving a second signal from the second component of the vehicle; processing the second signal to determine whether the first and second components of the vehicle are coupled.

The vehicle may be a train.

The second signal is a reflection of the first signal.

The method may further comprise processing the first and second signals to determine a distance between the first and second components of the vehicle; and determining whether the first and second components of the vehicle are physically coupled based upon the determined distance.

Determining whether the first and second components of the vehicle are coupled may comprise: comparing the determined distance with a predetermined distance; and determining that the first and second components are physically coupled if the determined distance is less than a predetermined distance.

The method may further comprise: transmitting a plurality of first signals; receiving a plurality of second signals; and processing the plurality of second signals to determine whether the first and second components of the vehicle are physically coupled.

The first signal may be an ultrasound signal.

The method may further comprise establishing a wireless connection between the first and second components of the vehicle, if but only if the first and second components of the vehicle are coupled. The wireless connection may be a wireless data connection. The wireless connection may be established between a first transceiver associated with the first component of the vehicle and a second transceiver associated with the second component of the vehicle. The first and second transceivers may be arranged to transmit signals in such a way that the transmitted signals are stronger in a direction substantially parallel to a longitudinal axis of the component of the vehicle with which the first and second transceivers are associated than the signals are in a direction perpendicular to the longitudinal axis. The first and second transceivers may be arranged to transmit signals substantially toward one another. Each of the first and second transceivers may comprise or be a directional antenna.

The method may comprise attempting to establish a connection between the first component and the second component; and if the connection can be established, transmitting a signal from the first component of the vehicle, or the second component of the vehicle, the signal comprising information which is at least indicative of a property of the second component, and information which is at least indicative of a property of the first component. The connection may be a connection via which information can be transmitted between the first and second components. The connection may be a wireless network connection. The connection may be a wired network connection.

If the connection can be established, the method may comprise transmitting a signal from the first component of the vehicle and the second component of the vehicle, each signal comprising information which is at least indicative of a property of the second component, and information which is at least indicative of a property of the first component. If the connection can not be established the method may comprise transmitting a signal from the first component of the vehicle or the second component of the vehicle, the or each signal comprising information which is at least indicative of a property of the component from which the signal is transmitted Information regarding the first and second components may be determined from the transmitted information which is at least indicative of a property of the components. An order of the components of the vehicle may be determined from the transmitted information which is at least indicative of a property of the components. The transmitted and/or determined information may be identification information for the components. The transmitted and/or determined information may be orientation information for the components. The transmitted and/or determined information may be used to provide instructions back to at least one of the components. The instructions may relate to information to be displayed in at least one component. The instructions may relate to a destination of at least one of the components. The instructions may relate to an opening or closing of a door of at least one of the components.

Each of the components may be provided with a transceiver for establishing the connection. A transceiver may be located at least one of two ends of each of the components. A transceiver may be located at each of two ends of each of the components.

The connection may only be established when the train components are adjacent to one another, and when one end of the first component is opposite to and facing one end of the second component. The connection may only be established when the components are coupled together.

A computer program may be provided that is configured to carry out the method of the first aspect of the present invention. A computer readable medium may be provided that is arranged to carry the computer program.

A device may be provided for determining whether first and second components of a vehicle are physically coupled together, the device comprising: a memory storing processor readable instructions; and a processor configured to read and execute instructions stored in the memory; wherein the processor readable instructions comprise instructions controlling the processor to carry out the method of the first aspect of the present invention.

According to a second aspect of the present invention, there is provided apparatus arranged to determine whether first and second components of a vehicle are physically coupled together, the apparatus comprising: a transmitter for wirelessly transmitting a first signal from the first component of the vehicle; a receiver for wirelessly receiving a second signal from the second component of the vehicle; a processing arrangement for processing the second signal to determine whether the first and second components of the vehicle are coupled. The transmitter and receiver may be the same piece of equipment, for example a transducer.

In use, the transmitter and/or receiver may be located on the first component and may be displaced from a longitudinal axis extending through the component, the displacement being in a direction parallel to a surface upon which the component is arranged to move.

In use, a transmitter and/or receiver may be located on the second component and may be displaced from a longitudinal axis extending through the component, the displacement being in a direction parallel to a surface upon which the component is arranged to move, such that, when coupled together, the transmitter and/or receiver of the first component is located on one side of a longitudinal axis extending through the first and second components, and in a direction parallel to a surface upon which the components are arranged to move, and the transmitter and/or receiver of the second component is located on another, opposite side of a longitudinal axis extending through the first and second components, and in a direction parallel to a surface upon which the component is arranged to move.

The first and second components may be arranged to move along a track, and wherein the longitudinal axis of the or each component is substantially parallel to and substantially vertically above a centreline extending along the track.

In use, the transmitter and/or receiver may be located on the first component, the first component being arranged to move along a track, and wherein the transmitter and/or receiver may be displaced from a centreline extending substantially perpendicularly and vertically from the centre of the track.

In use, a transmitter and/or receiver may be located on the second component, the second component also being arranged to move along a track, and wherein the transmitter and/or receiver may be displaced from a centreline extending substantially perpendicularly and vertically from the centre of the track such that, when coupled together, the transmitter and/or receiver of the first component is located on one side of the centreline extending perpendicularly from the centre of the track, and the transmitter and/or receiver of the second component is located on another, opposite side of the centreline extending perpendicularly from the centre of the track.

The transmitter and/or receiver may be located on at least the first component, the transmitter and/or receiver being located such that it is located on the component at a standard height above a surface upon which the component is arranged to move.

The apparatus may further comprise a first transceiver, which in use is located on the first component, and a second transceiver, which in use is located on the second component, the transceiver of each component being located such that when the first and second components are coupled together the transceiver of each component directly face one another.

The apparatus may further comprise a first transceiver which in use is located on the first component, the first component being arranged to move along a track, and wherein the location of the first transceiver coincides with a centreline extending substantially perpendicularly and vertically from the centre of the track.

The apparatus may further comprise a second transceiver which in use is located on the second component, the second component being arranged to move along a track, and wherein the location of the second transceiver coincides with a centreline extending substantially perpendicularly and vertically from the centre of the track.

The first and second aspects of the present invention are advantageous, since they allow the determination of the coupled or uncoupled state of components of a vehicle. This may be advantageous, since it may reduce or eliminate the possibility of signals being transmitted to or received by uncoupled vehicle components (e.g. train cars or carriages). This means that uncoupled components (for instance the end components of adjacent trains on the same track, or components of trains on different tracks), cannot transmit information to and from each other. This may be desirable, since uncoupled train components may belong to different trains or companies, different networks, etc. Furthermore, preventing transmission of data between uncoupled components may ensure that the available bandwidth for users in the respective components is not affected (e.g. reduced)

According to a third aspect of the present invention, there is provided a method of transmitting information between a first component of a vehicle and a second component of a vehicle, the method comprising: wirelessly transmitting a signal from the first component of the vehicle to the second component of the vehicle using a first transmitter; and wherein the first transmitter is configured such that the signal is transmitted in such a way that the signal is stronger in a direction substantially parallel to a longitudinal axis of the first component of the vehicle than the signal is in a direction perpendicular to the longitudinal axis.

The method may further comprise transmitting information between the second component of the vehicle and the first component of the vehicle, the method comprising: wirelessly transmitting a signal from the second component of the vehicle to the first component of the vehicle using a second transmitter; wherein the second transmitter is configured such that signal is transmitted in such a way that the signal is stronger in a direction substantially parallel to a longitudinal axis of the second component of the vehicle than the signal is in a direction perpendicular to the longitudinal axis.

The first and second transmitters may be arranged to transmit signals substantially toward one another.

The first and second transmitters may each comprise or be a directional antenna.

A wireless connection may only be established between the first and second components of the vehicle, if but only if the first and second components of the vehicle are coupled.

A computer program may be provided that is configured to carry out the method of the third aspect of the present invention. A computer readable medium may be provided that is arranged to carry the computer program.

A device may be provided for transmitting information between a first component of a vehicle and a second component of a vehicle, the device comprising: a memory storing processor readable instructions; and a processor configured to read and execute instructions stored in the memory; wherein the processor readable instructions comprise instructions controlling the processor to carry out the method of the first aspect of the present invention.

According to a fourth aspect of the present invention, there is provided apparatus arranged to transmit information between a first component of a vehicle and a second component of a vehicle, the apparatus comprising: a transmitter arranged to wirelessly transmit a signal from the first component of the vehicle to the second component of the vehicle; wherein the transmitter is configured such that the signal is transmitted in such a way that the signal is stronger in a direction substantially parallel to a longitudinal axis of the first component of the vehicle than the signal is in a direction perpendicular to the longitudinal axis.

The third and fourth aspects of the present invention are advantageous, since they reduce or eliminate the possibility of information being transmitted or received, or wireless networks being established between components which are not opposite and facing one another due to the directional nature of the transmission signal. This means that the possibility of establishing a connection with, for example, train components on different tracks is reduced or eliminated. This may me desirable, since train components on different tracks may belong to different companies, different networks, etc. Furthermore, preventing transmission of data between components which are not opposite and facing one another may ensure that the available bandwidth for users in the respective components is not affected (e.g. reduced)

According to a fifth aspect of the present invention, there is provided a method of transmitting information at least indicative of a property of a first component of a vehicle or a second component of a vehicle, the method comprising: attempting to establish a connection between the first component and the second component; and if the connection can be established, transmitting a signal from the first component of the vehicle, or the second component of the vehicle, the signal comprising information which is at least indicative of a property of the second component, and information which is at least indicative of a property of the first component, wherein an order and/or orientation of the components of the vehicle is determined from the transmitted information, or wherein the information comprises an order and/or orientation of the components.

The connection may be a connection via which information can be transmitted between the first and second components.

The connection may be a wireless network connection. The connection may be a wired network connection If the connection can be established the method may comprise transmitting a signal from the first component of the vehicle and the second component of the vehicle, each signal comprising information which is at least indicative of a property of the second component, and information which is at least indicative of a property of the first component.

If the connection can not be established the method may comprise transmitting a signal from the first component of the vehicle or the second component of the vehicle, the or each signal comprising information which is at least indicative of a property of the component from which the signal is transmitted Information regarding the first and second components may be determined from the transmitted information which is at least indicative of a property of the components.

An order of the components in the vehicle may be determined from the transmitted information which is at least indicative of a property of the components. The transmitted and/or determined information may be identification information for the components. The transmitted and/or determined information may be orientation information for the components.

The transmitted and/or determined information may be used to provide instructions back to at least one of the components. The instructions may relate to information to be displayed in at least one component. The instructions may relate to a destination of at least one of the components. The instructions may relate to an opening or closing of a door of at least one of the components.

Each of the components may be provided with a transceiver for establishing the connection. A transceiver may be located at one of two ends of each of the components. A transceiver may be located at each of two ends of each of the components.

The connection may only be established when the train components are adjacent to one another, and when one end of the first component is opposite to and facing one end of the second component.

The connection may only be established when the components are coupled together.

A computer program may be provided that is configured to carry out the method of the third aspect of the present invention. A computer readable medium may be provided that is arranged to carry the computer program.

A device may be provided for transmitting information at least indicative of a property of a first component of a vehicle or a second component of a vehicle, the device comprising: a memory storing processor readable instructions; and a processor configured to read and execute instructions stored in the memory; wherein the processor readable instructions comprise instructions controlling the processor to carry out the method of the first aspect of the present invention.

According to a sixth aspect of the present invention, there is provided apparatus arranged to transmit information at least indicative of a property of a first component of a vehicle or a second component of a vehicle, the apparatus comprising: a connection arrangement for attempting to establish a connection between the first component and the second component; wherein the arrangement is configured such that if a connection can be established, the connection arrangement is configured to transmit a signal from the first component of the vehicle, or the second component of the vehicle, the signal comprising information which is at least indicative of a property of the second component, and information which is at least indicative of a property of the first component, and wherein, in use, an order and/or orientation of the components of the vehicle is determined from the transmitted information, or wherein the information comprises an order and/or orientation of the components.

The fifth and sixth aspects of the present invention are advantageous, since they allow information related to the components of a vehicle to be readily determined. The fact that information related to a first component is transmitted together with information related to a second component only when a connection (e.g. a wireless network) is established between the components allows adjacency information to be readily established. For instance, if information related to a first component is transmitted together with information related to a second component, it is known that the first and second components are in connection with each from a communications perspective. The transmitted information can be identification information, orientation information, etc., allowing a map of the order and orientation of components of the vehicle to be readily established. For example, the orientation information could comprise information at least indicative of the end of the component to which a transceiver or the like is attached (for instance, an inter component link, described in more detail below). The map can be used to provide instructions back to the component, for example door opening and closing instructions, or destination information. By transmitting the information and/or looking at or for the transmitted information on a periodic basis, changes in the order of the components, or their orientation can be easily taken into account.

By using the ordering and orientation information, commands can be sent that are specific to certain directions relative to the orientation or positions within the ordering. For example, door opening or closing instructions can be directed to one side, e.g. the left, port side, of each component. Destination information or train announcements specific to only some components (e.g. the front four components) can be sent for display or announcement only in those components.

According to a seventh aspect of the present invention, there is provided a method comprising: wirelessly determining whether first and second components of a vehicle are physically coupled together; and establishing a wireless connection between the first and second components of the vehicle, if but only if the first and second components of the vehicle are coupled.

Determining whether the first and second components of a vehicle are coupled may comprise determining a distance between the first and second components of the vehicle.

A computer program may be provided that is configured to carry out the method of the third aspect of the present invention. A computer readable medium may be provided that is arranged to carry the computer program.

A device may be provided for determining whether first and second components of a vehicle are physically coupled together; and establishing a wireless connection between the first and second components of the vehicle, the device comprising: a memory storing processor readable instructions; and a processor configured to read and execute instructions stored in the memory; wherein the processor readable instructions comprise instructions controlling the processor to carry out the method of the first aspect of the present invention.

According to an eighth aspect of the present invention, there is provided apparatus comprising: an arrangement for wirelessly determining whether first and second components of a vehicle are physically coupled together; and a wireless connection arrangement for establishing a wireless connection between the first and second components of the vehicle, if but only if the first and second components of the vehicle are coupled.

The seventh and eighth aspects of the present invention are advantageous, since they may reduce or eliminate the possibility of signals being transmitted to or received by uncoupled vehicle components (e.g. train cars or carriages). This means that uncoupled components (for instance the end components of adjacent trains on the same track, or components of trains on different tracks), cannot transmit information to and from each other. This may me desirable, since uncoupled train components may belong to different trains or companies, different networks, etc. Furthermore, preventing transmission of data between uncoupled components may ensure that the available bandwidth for users in the respective components is not affected (e.g. reduced)

The methods according to aspects and embodiments of the present invention can be carried out in any one of a number of ways. For instance, a computer program may be configured to carry out the methods. A computer readable medium may be provided which carries the computer program. A device may be provided for carrying out the methods, the device, for instance, comprising: a memory storing processor readable instructions; and a processor configured to read and execute instructions stored in the memory; wherein the processor readable instructions comprises instructions controlling the processor to carry out the methods according to aspects or embodiments of the present invention. It will be appreciated that the use of such programs, mediums and devices are not essential, and the methods can be carried out in other ways.

Figure 4A:
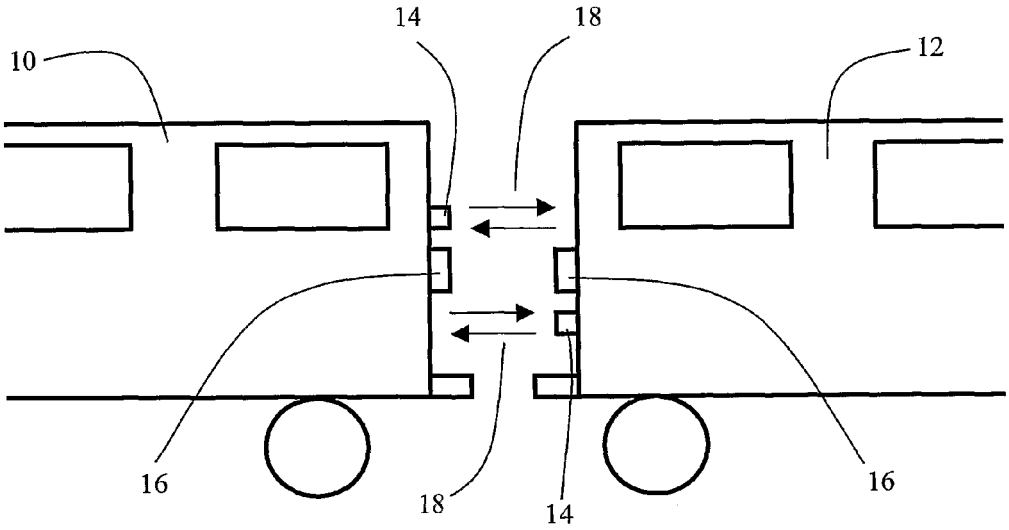
Figure 4B:
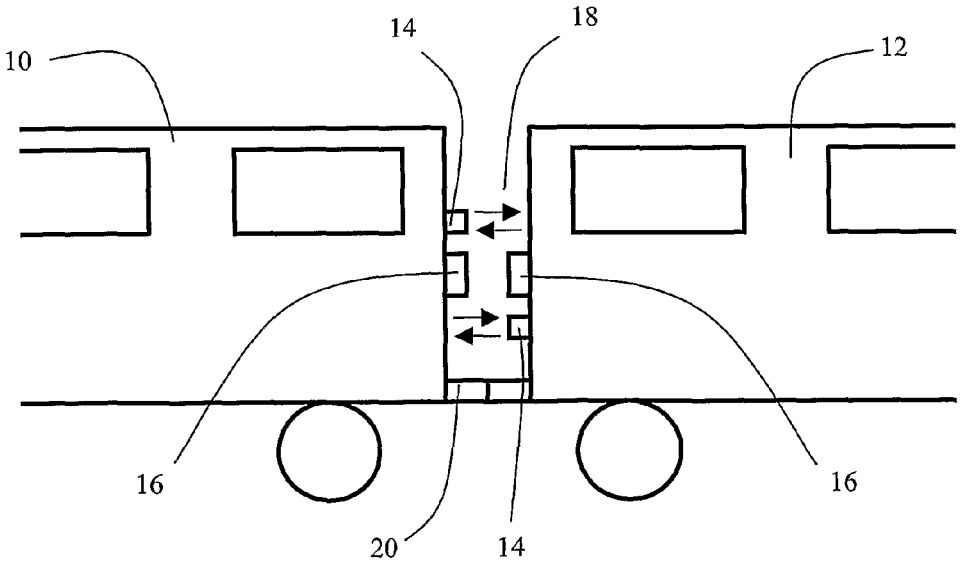
Figure 5:
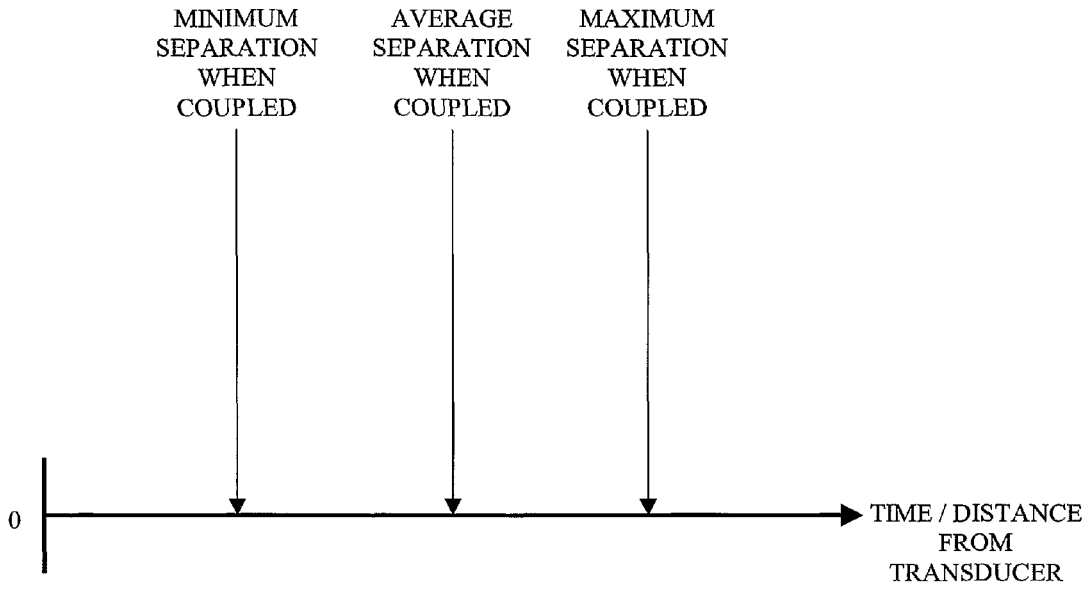

Specific embodiments of the present invention will now be described, by way of example only, with reference to the accompanying Figures, in which:

FIG. 1 schematically depicts a first train component and a second train component networked together using a wired connection;

FIG. 2 schematically depicts a first train component and a second train component networked together using a wireless connection;

FIGS. 3*a* and 3*b* schematically depict problems associated with the wireless connection shown in and described with reference to FIG. 2;

FIGS. 4*a* and 4*b* schematically depict an arrangement for determining the distance between two components of a vehicle in accordance with an embodiment of the present invention;

FIG. 5 schematically depicts operating principles of the embodiment shown in and described with reference to FIGS. 4*a* and 4*b;*

Figure 6:
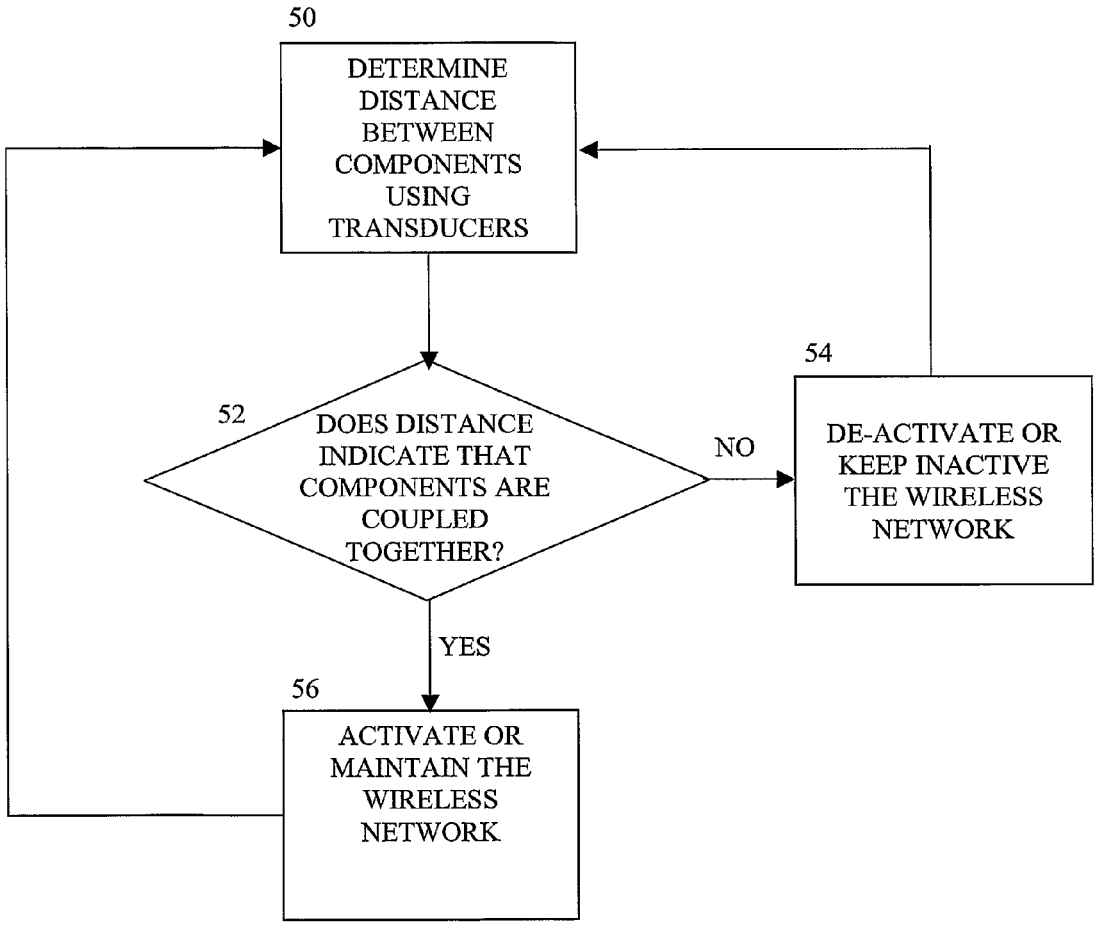

FIG. 6 is a flow chart schematically depicting further operating principles of the embodiment shown in and described with reference to FIGS. 4*a* and 4*b;*

Figure 7:
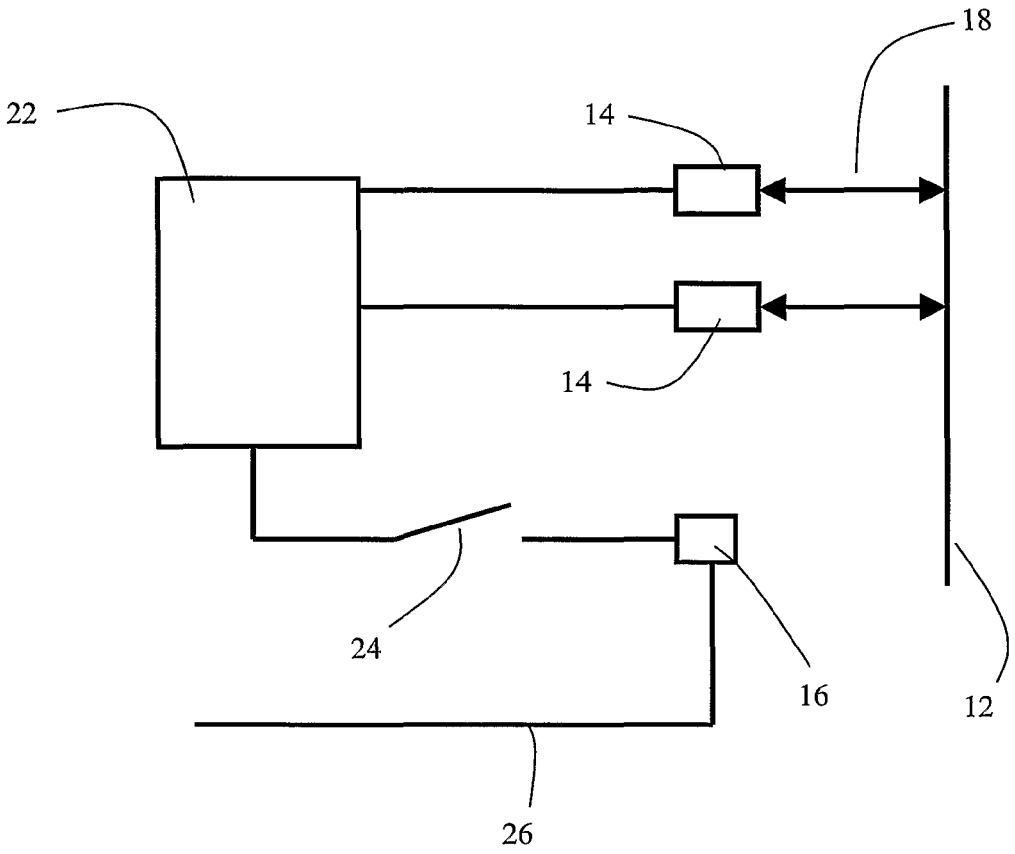

FIG. 7 schematically depicts yet further operating principles of the embodiment shown in and described with reference to FIGS. 4*a* and 4*b;*

Figure 8:
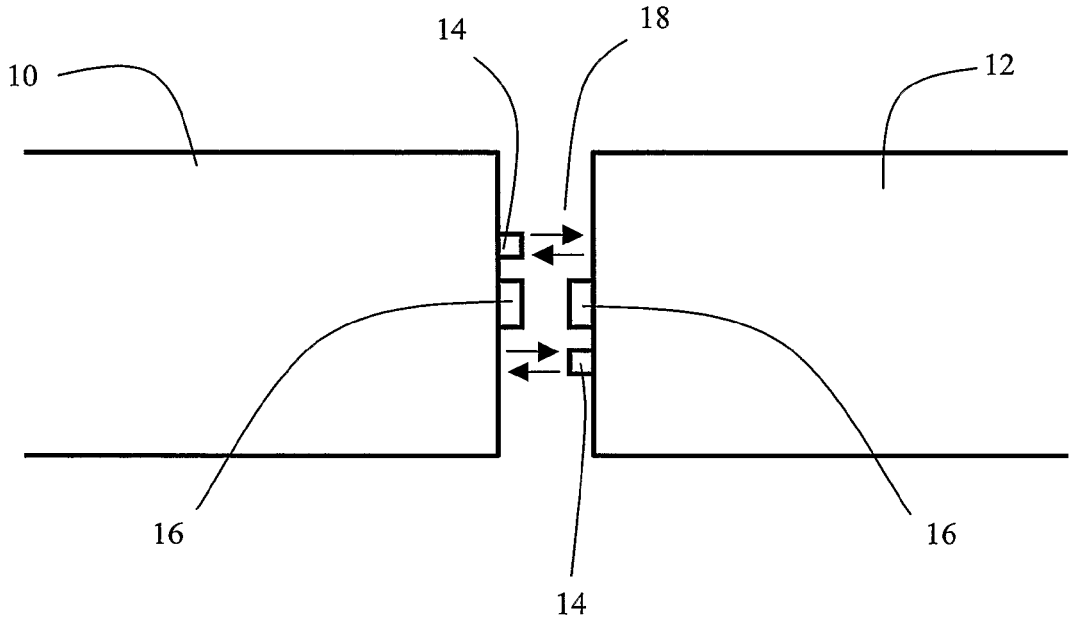
Figure 9A:
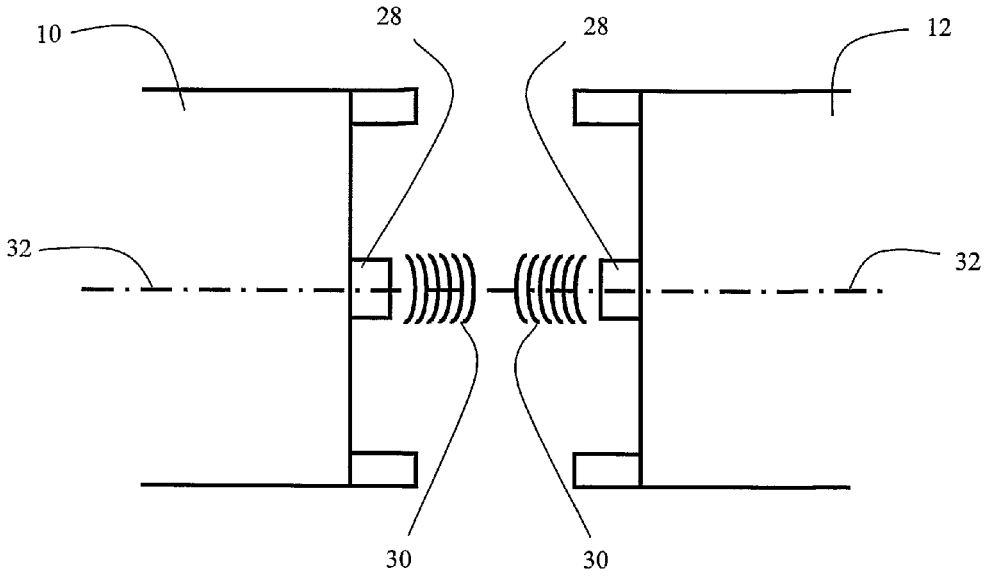
Figure 9B:
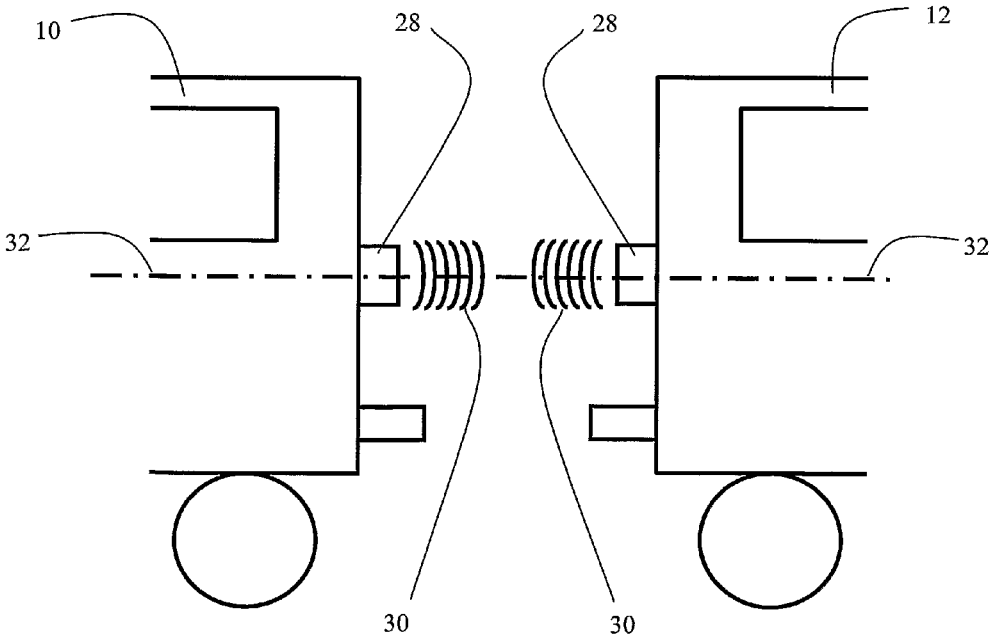
Figure 10:
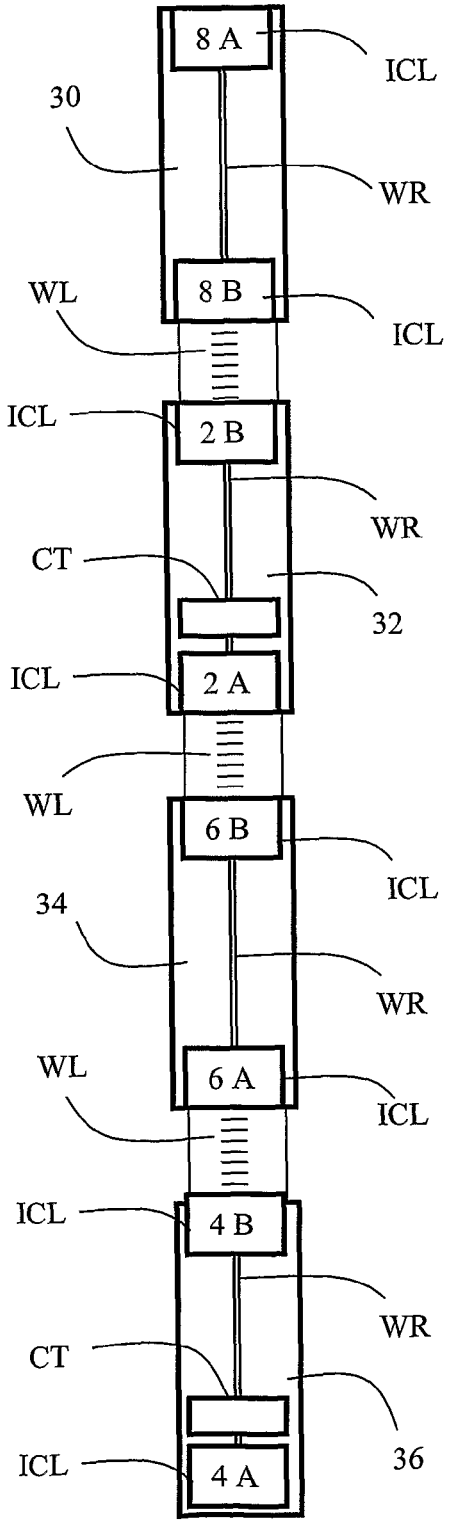

FIG. 8 schematically depicts an alternative arrangement for determining the distance between two components of a vehicle in accordance with an embodiment of the present invention;

FIGS. 9*a* and 9*b* schematically depict directional transmission of wireless signals between components of a vehicle in accordance with another embodiment of the present invention;

FIG. 10 schematically depicts identification and orientation information associated with a plurality of components of a vehicle; and FIGS. 11*a* and 11*b* schematically depict identification and orientation information obtainable from the plurality of vehicle components shown in and described with reference to FIG. 10, in accordance with a further embodiment of the present invention.

FIG. 4*a* depicts an arrangement in accordance with an embodiment of the present invention. The Figure shows a first train component adjacent to, but not coupled to, a second train component 12 on the same track. Each train component 10, 12 is provided with an ultrasonic transducer 14 and a wireless transceiver 16. The ultrasonic transducers 14 can be any suitable transducers, for example they can be 85 kHz transducer. The wireless transceivers 16 may be any suitable transceiver, and may be arranged for example to communicate using the IEEE 802.11a protocol.

It can be seen from the Figure that the ultrasonic transducers 14 are arranged to emit and receive ultrasonic signals 18. These ultrasonic signals 18 have to travel a certain distance from the ultrasonic transducer 14 before they are incident upon and reflected off a surface of an adjacent and opposed train component and back towards the ultrasonic transducer 14 where they can be detected. FIG. 4*b* shows the same train components 10, 12 as shown in FIG. 4*a*, but in FIG. 4*b* the first train component 10 and second train component 12 are coupled together via mechanical coupling elements 20. It can be seen from a comparison of FIGS. 4*a* and 4*b* that when the components 10, 12 are coupled together, the ultrasonic signals 18 emitted by the ultrasonic transducer 14 have to travel a shorter distance before they are reflected back towards and detected by the ultrasonic transducer than they have to travel when the components 10, 12 are not coupled together. It is therefore possible to obtain information at least indicative of a distance between the transducer and, for example, an adjacent and opposed train component using the distance travelled by the reflected ultrasonic signal 18, or in contrast by the time taken for the ultrasonic signal 18 to be detected by the ultrasonic transducer 14 after its been emitted.

The time taken for an ultrasonic signal to undertake a round trip from emission from an ultrasonic transducer, reflection off a surface, and detection by the same transducer may be used to determine if adjacent and opposed train components are coupled together. For example, if the adjacent and opposed train components are coupled together, the time taken for the ultrasonic signal to complete one round trip will be shorter than if the train components are not coupled together, and are instead a large distance apart from one another. This principle can be used to ensure that wireless communications are only undertaken between wireless transceivers of adjacent and opposed train components that are coupled together.

FIG. 5 is a schematic plot of the time taken for an ultrasonic signal to travel from a transducer provided on a first train component to reach a surface off which it is reflected (e.g. a surface of an adjacent and opposed train component), or in other words the distance travelled by the signal before it is reflected. Specific points are marked on the plot, which will now be described in more detail.

It can be seen that when the train components are coupled together there is an average separation between them. This is equivalent to an average time taken for the signal to travel from a transducer provided on a first train component to reach a surface off which it is reflected. The average separation of the two adjacent and opposed components when coupled takes into account the relative movement of the two adjacent and opposed components. For example, there may be some relative movement due to: mechanical interaction of coupling elements; movement of the components towards and away from each other as the components are pushed towards or pulled away from each other; and relative movement of the components as the train moves around a corner. In other words, the separation between the components is not constant even when the components of the train are coupled together.

For a first component coupled to a second component, there will be a maximum and minimum separation between the components when they are coupled, and this is marked on the plot in FIG. 5. If the ultrasonic signal travels a distance before it is reflected which is greater than the maximum possible separation when coupled, it will be known that the components of the train are no longer coupled together. When the separation is found to exceed the maximum separation shown in the Figure, the wireless network may be deactivated by preventing one or both of the wireless transceivers on the first and second components from transmitting and/or receiving data. Alternatively, instead of deactivating the network, the network may be changed to a different operating state, for example keeping the network activated but preventing the transfer of data between uncoupled components. If the distance travelled by the signal is found to be less than the maximum separation when coupled, the wireless network may be activated or maintained.

When components of the train are brought together to be coupled, they may not actually be coupled together until a certain mechanical interlock or the like has been established. In order to establish this interlock, it may be necessary to move the components closer together than they would be on average when coupled together (e.g. when the train is moving). When this separation has been achieved, the wireless network can be activated.

The activation or deactivation of the wireless network may not be based on the detected distance between the components being greater or less than a single threshold separating distance. Alternatively or additionally, the activation or deactivation of the wireless network may be dependent upon whether the components are moving from a coupled to an uncoupled state, or from an uncoupled to a coupled state. For instance, when a network connection is established, and the trains are coupled together, the components may need to be pulled apart by a greater than average separation in order to overcome a mechanical interlock between the two components. Only when this required separation is exceeded will the wireless network be deactivated. Conversely, in order to couple together two components which were previously uncoupled, the components may need to be pushed together such that their separation is lower than the average coupled separation in order to achieve a mechanical interlock between the train components. In other words, when coupling the components, they may be separated by a distance which is less than an average coupled distance before they are actually coupled together. The wireless network may only be activated when this lower than average separation is detected. Of course, the separations that need to be measured before the wireless network is activated or deactivated will be specific to certain trains and coupling elements, and the transducers and any control arrangements can be configured to take into account such specifics.

FIG. 6 depicts a flow chart depicting a simplified process which may be undertaken to ensure that the wireless network is suitably activated, maintained, de-activated or kept inactive. It can be seen that the distance between adjacent and opposed components is determined using the transducers as discussed above 50. The distance could be determined periodically, for example every second or so. Next, it is determined whether the distance between the components indicates that they are coupled to one another 52.

If the distance indicates that the components are no longer coupled together, the wireless network will be de-activated, or if the wireless network was not activated in the first place, the wireless network will be kept inactive 54. The distance between the components is then determined again 50, and then it is again determined whether the distance between the components indicates that they are coupled to one another 52.

If, the distance indicates that the components are indeed coupled together, the wireless network will be activated, or if it is already active, maintained in an active state 56. The distance between the components is then determined again 50, and then it is again determined whether the distance between the components indicates that they are coupled to one another 52.

FIG. 7 illustrates an arrangement configured to implement the process shown by the flow chart of FIG. 6. FIG. 7 shows two ultrasonic transducers 14. Although only one ultrasonic transducer 14 has been described above, more than one transducer can be used, for example, to improve redundancy. The ultrasonic transducers 14 are shown as emitting and receiving ultrasonic signals 18 which are reflected off a surface of the second train component 12. The transducers 14 are in communication with a control unit 22, for example a computer, embedded processor, processor etc. The control unit 22 is also in communication with the wireless transceiver 16 via a switch 24 (e.g. a GaAs switch). The wireless transceiver 16 may also be provided with a wired connection 26 for example to another wireless transceiver at another location in the train component. Only if the control unit 22 determines that the separation between the first component of the train and second component of the train is such that the components are coupled together it will close the switch 24 (or keep it closed) and thus activate the wireless transceiver 16 or keep it in active state (e.g. to receive and/or transmit data). If the control unit 22 determines that the separation between the first component of the train and second component of the train is such that the components are not coupled together it will open the switch 24 (or keep it open) thus deactivating the wireless transceiver 16 or keeping it in a deactivated state.

A similar arrangement to that shown in FIG. 7 may be provided at each end of a train component to ensure that communication between adjacent ends of adjacent and opposed train components can only be undertaken when one or more transducers of both train components are used to obtain information indicating that the train components are coupled together, such that a wireless network can be established.

As mentioned a single transducer may be used at the end of each train component. Alternatively, one or more transducers may be used to improve redundancy or safety. For example, if more than one transducer is used, it could well be that the components are deemed to be coupled together if only a single transducer provides information indicating that the components are coupled together. On the other hand, it may well be that the wireless network is only established if all of the transducers provide information indicating that the components are coupled together.

It will be appreciated that the arrangements shown in and described with reference to FIGS. 4 to 7 overcome at least some of the problems of the prior art, for example those described with reference to FIG. 3A above. For instance, by employing the arrangement shown in and described with reference to FIGS. 4 to 7, it is not possible for a wireless network to be accidentally established between adjacent and opposed train components which are facing each other but which are not coupled.

It will be appreciated that it is not essential that the distance between the components is determined using an ultrasonic transducer arrangement. Any suitable arrangement may be used to determine the distance. For example, any electromagnetic or pressure wave arrangement could be used. The signals do not need to be reflected from a surface of the component. Instead, the signals could be detected by a detector on a surface of the component and then transmitted in the same or different form back toward a source from which the signal was generated. If the detection and transmission is undertaken quickly enough (or example in microseconds, nanoseconds, or less), the distance between the components may still be determined with sufficient accuracy.

FIG. 4 schematically depicts ultrasonic transducers and wireless transceivers disposed on a train component in a vertical arrangement (i.e. the transducer at one end of a component is located directly above or below the transceiver at that end of the component). This layout is not essential. The transducers and transceivers may be located in any suitable manner. The transducers and transceivers at the end of a train component may be suitably located to take into account the fact that any one of a number of different train components may be coupled together. FIG. 8 shows such an arrangement in plan view. Looking end-on at the end of a given train component 10, 12, the transducer 14 may be located to the right hand side of the transceiver 16, for example by 10 cm. If the transducers 14 and transceivers 16 of ends of other train components 10, 12 are positioned in the same way (as is the case in the Figure), when the components 10, 12 are coupled together, the transducer 14 of one component 10 will be 20 cm away (in the horizontal direction) from the transducer 14 of another component 12. This means that the transducers 14 of adjacent and opposed train components 10, 12 will not face one another directly, and will not therefore interfere with each other. If the transducers 14 did directly face one another, the distance between the train components 10, 12 may be inaccurately determined, and instead the distance between transducers 14 would be found. This may be undesirable, for example, if it desired to determine the distance between the main bodies of the train components 10, 12 and not the transducers 14 of adjacent and opposed (e.g. coupled) components 10, 12. The vertical arrangement shown in FIG. 4 is therefore not as useful as the horizontal arrangement shown in FIG. 8, since the arrangement shown in FIG. 4 could result in adjacent and opposed components having transducers that are opposite one another, with the associated problems as described above.

In a preferred arrangement, the transceivers that communicate with one another to form the data communication network are preferably placed so that they (or more generally their antennae) face each other directly when adjacent and opposed components are coupled, whichever way round the components are oriented. In the case of a plurality of components with a single transceiver provided at each end of each component, this can be achieved by placing the transceivers on the ends of the components so that they are at the same height (e.g. a standard height) above the surface on which the component is arranged to travel (e.g. rails). In the case where the surface is or are rails, the transceivers may be located vertically above the centreline of the tracks.

If it desired that the transmitters and/or receivers (e.g. transducers) used for distance measurements should not be directly opposite one another, perhaps because they are designed to receive signals from a flat plate, RFID tag or other target that is directly opposite, then they can be placed on the ends of the components with a horizontal offset. The horizontal offset may be from the centreline of, for example, the rails that the components are arranged to travel on, or a longitudinal axis extending through the component. The offset is preferably in the same sense when viewing each component end on (i.e. left or right of the centreline or axis). In this way, when the components are brought together, the transmitters and/or receivers of the components will always be separated by a horizontal distance which is the sum of the offsets for each transmitter and/or receiver. If it is desired that the transmitters and/or receivers are directly facing the flat plate, RFID tag or other target, then the transmitters and/or receivers should all be placed at the same horizontal offset (e.g. 10 cm to the left of the centreline of the rails or from the longitudinal axis of the component), and at a same standard height above the rails (e.g. 2 metres), or whatever surface the components are arranged to travel on. Similarly, the targets should be placed at an opposite horizontal offset (e.g. 10 cm to the right of the centreline of the rails or the longitudinal axis of the component) and at that same standard height above the rails.

In general, then, a transceiver for establishing a wireless network connection between first and second components, together with a transmitter and/or receiver for determining the distance between the components maybe located on the first component (and, of course, other components). The transceiver, transmitter and/or receiver maybe displaced from one another in a direction parallel to a surface upon which the component is arranged to move (e.g. the ground, or in other words the horizontal direction). The transceiver, transmitter and/or receiver may also be displaced from one another in a direction that is not parallel to a surface upon which the component is arranged to move.

FIGS. 9*a* and 9*b* schematically depict another embodiment of the present invention in plan view and side view respectively. FIG. 9*a* shows a first train component 10 and a second train component 12. Each train component 10, 12 is provided with a wireless transceiver 28. It can be seen from FIGS. 9*a* and 9*b* that the wireless transceivers of 28 of each train component 10, 12 are located on each component such that they are opposite one another, and such that they face one another. Each radio transceiver 28 is arranged to transmit signals 30 which have a field strength profile which is greater in strength in a direction parallel to a longitudinal axis 32 extending through the respective train component 10, 12 to which the wireless transceiver 28 is attached than it is in a direction perpendicular to the axis 32. It can be seen that in the embodiment shown in FIGS. 9*a* and 9*b*, the wireless transceiver 28 is located on this longitudinal axis 32, and thus is actually arranged to transmit signals which have a field strength which is greatest along (and not just parallel to) the longitudinal axis 32.

The wireless transceiver 28 is able to transmit signals with such a specific field strength profile because of the design of an antenna which the wireless transceiver 28 uses to send and receive signals. The antenna is a directional antenna, meaning that its transmission profile is not isotropic, but has different strengths in different directions. Such antennas are known in the field of antenna design, and so will not be described in great detail here. It is sufficient to say that any antenna which has a transmission field strength profile which is greater in strength in a direction parallel to a longitudinal axis extending through the respective train component to which the wireless transceiver is attached than it is in a direction perpendicular to the axis is suitable. For instance, a printed circuit board patch antenna may be used, or a strip or planar antenna, which has, for example, a 3 dB loss in signal strength for every 10° shift in angle away from a centre of focus of the antenna's transmission profile (e.g. a 10° shift in angle away from the longitudinal axis, and/or the general expected or predicted location of another transceiver when the components are coupled together).

Since the wireless transceivers 28 are arranged to transmit signals which have a field strength greatest in a direction parallel to a longitudinal axis extending through the associated train component, the possibility of the transmitted signal being directed towards and received by a wireless transceiver which is not directly opposite is eliminated or reduced. This means that the problems shown in and described with reference to FIG. 3*b* above are avoided. This is because in accordance with an embodiment of the present invention, the signals transmitted by the wireless transceivers do not have a uniform and radial field profile, meaning that the possibility of wireless communication with, for example, trains on an adjacent track (in other words, neighbouring trains) is reduced or eliminated.

The wireless transceivers described above can use any suitable wireless communication, and are not restricted to the use of the IEEE 802.11a protocol.

In some embodiments, the apparatus used to determine the distance between the train components may be the same or a part of the same apparatus that is used to establish a wireless network between the two components. For instance, a portion of a wireless data signal that is reflected back from a surface of an adjacent and opposed component may be used to determine the distance between adjacent and opposed components.

In some embodiments, each train component may be provided with more than one transceiver, for example two transceivers. Two transceivers on one component communicating with two transceivers on an adjacent and opposed component may be advantageous. For instance, one transceiver on a component may be arranged to only receive information, whereas the other transceiver may be arranged to only transmit information. This may increase the available bandwidth for data transfer. Because the transceivers are arranged to transmit signals which have a field strength greatest in a direction parallel to a longitudinal axis extending through the associated train component, the possibility of cross-talk between different transceivers is eliminated or reduced.

It will be appreciated that the transceiver shown in and described with reference to FIGS. 9*a* and 9*b* can be used in conjunction with the embodiment shown in and described with reference to FIGS. 4 to 8, such that the advantageous field strength profile of the wireless transceiver of FIGS. 9*a* and 9*b* may only transmit and receive signals when the train component to which is attached is coupled to another adjacent and opposed train component.

FIGS. 10, 11*a* and 11*b* schematically depict another embodiment of the present invention. Referring to FIG. 10, a plurality of train components (in other words, cars of a train) is shown. Four train components as shown as being coupled together: a first train component 30; a second train component 32; a third train component 34; and a fourth train component 36.

Each train component is provided with an inter component link ICL at opposite ends of the component. The inter component link ICL may comprise a wireless transceiver for communicating with adjacent inter component links ICL at the ends of other train components (for example, as described above in the embodiments shown in and described with reference to FIGS. 4 to 8, and FIG. 9). The inter component links ICL are also provided with identification information, which the inter component link ICL can transmit (e.g. broadcast). This information can be in the form of a different signal which the inter component link ICL transmits, a different form of signal, data in that signal, or any other suitable arrangement or configuration. For example, it can be seen that in the first train component 30, the inter component link ICL at one end of the train is able to provide identifying information comprising a number which relates to that train component (in this case, the number '8') and also a letter indicating the end of the train component where the inter component link ICL is located (in this case, A, which in this case indicates the front of the train component). It can be seen from the Figure that each inter component link ICL contains or is associated with different identifying information. This means that each inter component link ICL can provide identifying information code which identifies not only the train component by the number, but also the relative orientation of the train component, by the letter A or B.

Inter component links ICL in a given train component are connected together using a wired network (e.g. an Ethernet network) WR and are able to transmit and receive information from one another via the wired network WR. In contrast, inter component links ICL of different train components may only communicate with each other by establishing a wireless network connection or bridge WL with one another. Preferably, the inter component links ICL are configured such that they can only establish a wireless connection WL with inter component links ICL of opposing (e.g. opposed and adjacent) train components. For instance, the inter component link ICL may be arranged to take advantage of the embodiments described above, specifically with regard to not being able to transmit or receive information unless the train component of which it is a part is coupled to another adjacent and opposed component, and/or the fact that the inter component link ICL can only transmit a signal which has a greater field strength along a longitudinal axis extending through the train component of which the inter component link ICL is a part.

If and/or when an inter component link ICL at a second end of the first component 30 is able to establish a wireless communications link (or in other words, a network connection) WL with an adjacent and opposed inter component link ICL of a first end of the second component 32, both inter component links ICL transmit (e.g. broadcast) to each other their identification information. In general, all inter component links ICL which have established a wireless connection WL with an inter component link ICL of an adjacent and opposed train component transmit to each other their identification information. The information may be transmitted periodically, say every 5 or 10 seconds. Those inter component links ICL that are not able to establish a wireless connection WL with an inter component link ICL of an adjacent and opposed train component (i.e. those inter component links ICL located at either end of the train) do not transmit their identification information to an inter component link ICL of an adjacent and opposed train component.

When a wireless connection WL has been established between inter component links ICL of adjacent and opposed train components, the connected inter component links ICL periodically transmit (e.g. broadcast) their own identification information, as well as the identification information of the inter component link ICL which it is in wireless connection WL with. For example, the inter component link ICL at one end of the third train component (i.e. ICL 6B) may transmit its own identification information (ICL 6B) followed by the identification information of the inter component link which it is wireless connection WL with (i.e. ICL 2A of the second train component). The identification information transmitted by each inter component link ICL may be passed along the wired WR and wireless WL connections of the train.

Command terminals CT may be provided in some or all of the train components. The command terminals CT are typically situated in or adjacent to a driving console, from where, for example, the train or an engine of the component may be driven. The command terminals CT can be used to receive, process and/or store, etc. the identification information which is being transmitted by the inter component links ICL. Alternatively or additionally, the information that is being or has been transmitted by the inter component links ICL can be stored somewhere which is accessible by the command terminals CT. The command terminals CT can use the information transmitted by the inter component links ICL to determine the components which make up the train, and also the orientation of these components, as will be described in more detail below.

Taking the command terminal CT in the second train component 32 as an example, the command terminal CT can interrogate (in other words, look at) the inter component links ICL or look up information in the data store already obtained from the inter component links ICL. In one example, the command terminal CT can look at or look up inter component link ICL 2A, which is at the front of the second train component 32. It will be determined that ICL 2A is transmitting its own identification information, as well as that of ICL 6B of the third train component 34. It can therefore be inferred that ICL 2A has established a wireless connection with ICL 6B, and that the second train component 32 is adjacent and opposed to the third train component 34.

There is no need to interrogate or look up inter component link ICL 6B, since it is known that there will be another inter component link ICL at the other end of the third train component 34, i.e. ICL 6A. The command terminal CT can look at or look up inter component link ICL 6A to determine if it is wirelessly connected WL with another inter component link ICL. It will be found that ICL 6A is not only transmitting its own identification information, but also that of ICL 4B of the forth train component 36. It can therefore be inferred that ICL 6A has established a wireless connection WL with ICL 4B, and that the third train component 34 is adjacent and opposed to the forth train component 36.

There is no need to interrogate or look up inter component link ICL 4B, since it is known that there will be another inter component link ICL at the other end of the forth train component 36, i.e. ICL 4A. The command terminal CT can look at or look up inter component link ICL 4A to determine if it is wirelessly connected WL with another inter component link ICL. It will be found that ICL 4A is only transmitting its own identification information. It can therefore be inferred that ICL 4A has not established a wireless connection WL with another ICL, and that ICL 4A is therefore located at an end of the train.

The same process of the command terminal CT in the second train component 32 looking at or looking up inter component links ICL can be repeated in the other direction, i.e. in the direction of the ICL 2B, which is at the rear of the second train component. It will be determined that ICL 2B is transmitting its own identification information, as well as that of ICL 8B of the first train component 30. It can therefore be inferred that ICL 2B has established a wireless connection with ICL 8B, and that the second train component 32 is adjacent and opposed to the first train component 30.

There is no need to interrogate or look up inter component link ICL 8B, since it is known that there will be another inter component link ICL at the other end of the first train component 30, i.e. ICL 8A. The command terminal CT can look at or look up inter component link ICL 8A to determine if it is wirelessly connected WL with another inter component link ICL. It will be found that ICL 8A is only transmitting its own identification information. It can therefore be inferred that ICL 8A has not established a wireless connection WL with another ICL, and that ICL 8A is therefore located at an end of the train.

By looking at (e.g. interrogating or receiving transmitted information from) or looking up (e.g. in a data store) the inter component links ICL, a record of how the inter component links ICLs are wireless connected to each other (or not, as the case may be) can be established. Such a record for the command terminal CT in the second train component 32 is shown in FIG. 11*a*.

FIG. 11*a* shows a record of inter component links ICL that have been looked up or looked at by the command terminal CT in the second train component 32 (in this example, in the look up order described above), and the inter component link ICL which it was found that they were in wireless connection with. It will be apparent that the record gives the order of the train components, as well as the orientation of the train components. For instance, FIG. 11*b* shows how the command terminal, looking in the direction of ICL 2A can determine the order and orientation of the train components in that direction. It can be seen that the inter component links ICL are in the following order:

ICL 2A
ICL 6B
ICL 6A
ICL 4B
ICL 4A <end of train>

Looking in the direction of ICL 2B it can be seen that the inter component links ICL are in the following order:

ICL 2B
ICL 8B
ICL 8A <end of train>

From one end of the train to the other, the order of inter component links ICL is therefore as follows:

ICL 8A <end of train>
ICL 8B
ICL 2B
ICL 2A
ICL 6B
ICL 6A
ICL 4B
ICL 4A <end of train>

It will be appreciated that the order of the inter component links ICL in the record of FIGS. 11*a* and 11*b* corresponds with the order of the inter component links ICL as they appear on the train components shown in FIG. 10. This demonstrates that the command terminal CT is able to build up and even display a picture, map or diagram or the like of the layout of the train using the transmission of identification information between inter component links ICL of adjacent and opposed train components. This means that it is then possible to send instructions (e.g. issue commands) over the wireless network which is established between components of the train (and the wired network within the components), taking into account the exact makeup of the train, for instance the identification of the components and their orientation. For example, it may be desired to open all of the doors on the right hand side of the train when approaching a station. Since the orientation of the components of the train will be known from the record (or interrogation), it will be possible to identify which doors in each component need to be open to ensure that all of the doors on the right hand side of the train as a whole are opened. In another example, if certain components of the train are going to different destinations, the command terminal CT can be used to provide instructions to displays in the components to reflect the different destinations. Of course, other applications are possible using the record, look up or look at process mentioned above.

The command terminal CT may look up or at the inter component links ICL periodically, say every 5 or 10 seconds or so, in order to check if the components of the train, or their orientation, have changed.

Although the embodiment shown in and described with reference to FIGS. 10 and 11 has been described as using wireless communications between train components, the embodiment may be implemented using other connection arrangements such as wired communications. For instance, in a wired communications network, information could be exchanged or transmitted which relates to, for example, ports which one or more parts of components parts (e.g. wires) of the network are connected to. In other embodiments, ends of components may be provided with an RFID tag (or the like) and/or a reader.

Adjacent and opposed ends of components can use the readers to read information (e.g. an ID) from the RFID tag of an opposing and adjacent component in much the same way as in the wireless network described above. The reader can then transmit the received (in other words, read) information as well as the information associated with the RFID tag located on the same component as the reader. As described above, a record can be obtained and stored for subsequent lookup. Such an RFID arrangement may alternatively or additionally be used to determine the distances between adjacent and opposed train components. The RFID arrangement may therefore be used in place of or in addition to the arrangements described above for networking or distance finding.

The embodiment shown in and described with reference to FIGS. 10 and 11 may be combined with one or both of the embodiments shown in and described with reference to FIGS. 4 to 8, and in FIG. 9.

While the embodiments described above have been described in relation to components of trains, the methods and apparatus described are equally applicable to or in any vehicle comprising more than one component. For instance, the methods and apparatus are equally applicable to a lorry having a first and second component, for example a front cab and an attached load, or a car and caravan or trailer.

It will be appreciated that the forgoing embodiments have been described by way of example only. The skilled person will appreciate that various modifications may be made to these and other embodiments, without departing from the invention as defined by the claims that follow.

The invention claimed is:

1. A method for determining whether to establish a wireless connection between adjacent first and second components of a vehicle, the method comprising:

wirelessly transmitting a first signal from the first component of the vehicle;

wirelessly receiving a second signal from the second component of the vehicle;

processing the first and second signals to determine a distance between the adjacent first and second components of the vehicle;

determining whether the first and second components of the vehicle are physically coupled or uncoupled based upon the determined distance; and establishing a wireless connection between the first and second components of the vehicle, if but only if the first and second components of the vehicle are coupled;

wherein said wireless connection is prevented when the first and second components are determined to be uncoupled based upon the determined distance.

2. A method according to claim 1, wherein the vehicle is a train.

3. A method according to claim 1, wherein the second signal is a reflection of the first signal.

4. A method according to claim 1, wherein determining whether the first and second components of the vehicle are coupled or uncoupled comprises:

comparing the determined distance with a predetermined distance, wherein said predetermined distance is a maximum separation between the first and second components when coupled; and determining that the first and second components are physically coupled if the determined distance is less than the predetermined distance.

5. The method of claim 4 wherein said maximum separation is greater than an average separation that takes into account relative movements between the first and second components.

6. A method according to claim 1, further comprising:

transmitting a plurality of first signals;

receiving a plurality of second signals; and processing the plurality of second signals to determine whether the first and second components of the vehicle are physically coupled.

7. A method according to claim 1, wherein the first signal is an ultrasound signal.

8. A method according to claim 1, wherein the wireless connection is only established when the vehicle components are adjacent to one another, and when one end of the first component is opposite to and facing one end of the second component.

9. A non-transitory computer readable medium carrying a computer program to carry out the method of claim 1.

10. The method of claim 1 wherein said vehicle is a moving vehicle.

11. A device for determining whether to establish a wireless connection between first and second components of a vehicle, the device comprising:

a memory storing processor readable instructions; and a processor configured to read and execute instructions stored in the memory; wherein the processor readable instructions comprise instructions controlling the processor to carry out the method of claim 1.

12. Apparatus arranged to determine whether to establish a wireless connection between first and second components of a vehicle, the apparatus comprising:

a transmitter for wirelessly transmitting a first signal from the first component of the vehicle;

a receiver for wirelessly receiving a second signal from the second component of the vehicle;

a processing arrangement for processing the first and second signals to determine a maximum distance between the first and second components of the vehicle, and to determine whether the first and second components of the vehicle are physically coupled or uncoupled based upon the determined maximum distance;

and a wireless connection arrangement for establishing a wireless connection between the first and second components of the vehicle, if but only if the first and second components of the vehicle are coupled.

* * * * *